United States Patent [19]

Lyon et al.

[11] 4,285,283

[45] Aug. 25, 1981

[54] COAL COMBUSTION PROCESS

[75] Inventors: Richard K. Lyon, Fanwood; Howard Freund, Warren, both of N.J.

[73] Assignee: Exxon Research & Engineering Co., Florham Park, N.J.

[21] Appl. No.: 101,210

[22] Filed: Dec. 7, 1979

[51] Int. Cl.[3] ..... F23D 1/00

[52] U.S. Cl. ..... 110/347; 48/210; 110/229; 431/10

[58] Field of Search ..... 110/347, 229, 230, 341, 110/263, 266; 431/2, 10; 48/101, 210, 197 R

[56] References Cited

U.S. PATENT DOCUMENTS

| | | | |
|---|---|---|---|
| 2,830,883 | 4/1958 | Eastman | 48/206 |
| 3,727,562 | 4/1973 | Bauer | 431/10 X |
| 3,746,498 | 7/1973 | Stengel | 431/10 X |
| 3,969,089 | 7/1976 | Moss et al. | 48/197 R |
| 4,021,186 | 5/1977 | Tenner | 431/10 |
| 4,026,679 | 5/1977 | Collin | 48/73 |
| 4,060,397 | 11/1977 | Buiter et al. | 48/197 R |
| 4,144,017 | 3/1979 | Barsin et al. | 431/10 |

OTHER PUBLICATIONS

*Sulfur Retention in Coal Ash,* EPA-600/7-78-153b, Nov. 1978.

*The Scale Up of a Fluidized-Bed Combustion System to Utility Boilers,* AIChe Symposium Series, vol. 67, No. 116, 1971.

*Experimental Studies on the Feasibility of In-Furnace Control of $SO_2$ and $NO_x$ Emissions from Industrial Stokers,* Battelle Energy Program Report, Dec. 15, 1975.

*Primary Examiner*—Edward G. Favors

*Attorney, Agent, or Firm*—Henry E. Naylor

[57] ABSTRACT

Disclosed is a process for combusting coal wherein the emission of $SO_x$ or the emission of $SO_x$ and $NO_x$ are minimized. The process comprises (a) providing a coal containing at least twice as much organic calcium than sulfur; (b) burning the coal at a temperature greater than about 1200° C. under reducing conditions; (c) separating the solid effluents from the gaseous effluents; and (d) burning the gaseous effluents at a temperature from about 1000° C. to 1500° C. under oxidizing conditions.

6 Claims, No Drawings

COAL COMBUSTION PROCESS

BACKGROUND OF THE INVENTION

1. Field of the Invention

The present invention relates to a method for the combustion of coal wherein substantially all of the sulfur content of the coal is retained in the solid effluents and if desired, the resulting gaseous effluents are substantially free of $NO_x$.

2. Description of the Prior Art

Although coal is by far our most abundant fossil fuel, there are serious problems connected with its use which has prevented it from reaching its full commercial exploitation. Examples of some such problems include problems in handling, waste disposal and pollution. As a result, oil and gas have acquired a dominant position, from the standpoint of fuel sources, throughout the world. This, of course, has led to depletion of proven petroleum and gas reserves to a dangerous level from both a worldwide energy, was well as an economic point of view.

One area in which it is desirable to replace petroleum and gas as an energy source, with coal, is in industries where coal can be burned in combustion devices such as boilers and furnaces. Owing to environmental considerations, the gaseous effluents resulting from the combustion of coal in these devices must be substantially pollution free—expecially with respect to sulfur and nitrogen oxides. Under prior art technology, separate processes were needed to control $SO_x$ and $NO_x$. $SO_x$ was controlled by wet scrubbing. The cost of wet scrubbing is prohibitive on small installations and excessive on large scale operations. There are also serious operating problems associated with wet scrubbers. $NO_x$ control in the prior art has been achieved by two stage combustion and by post combustion $NO_x$ reduction. The former process involves burning coal in two stages, the first under reducing conditions and the second under oxidizing conditions. Although two stage combustion is both inexpensive and reliable it is believed to have limited effectiveness for control of $NO_x$ and is generally believed to be of no effectiveness for $SO_x$ control. Post combustion $NO_x$ reduction technologies are effective for $NO_x$, but not for $SO_x$; and are generally expensive.

SUMMARY OF THE INVENTION

In accordance with the present invention there is provided a process for combusting coal wherein the emission of $SO_x$ or $SO_x$ and $NO_x$ are minimized. The process comprises (a) providing coal containing organic calcium to sulfur at a ratio of at least 2 to 1 for coal containing less than 1 percent by weight of sulfur and a ratio of at least 1 to 1 for coal containing greater than 1 percent by weight of sulfur; (b) burning the coal at temperatures greater than about 1200° C. in a first combustion zone in the presence of an oxidizing agent but under reducing conditions such that the equivalence ratio of coal to oxidizing agent is at least 1.5; (c) separating the resulting solid effluents from the gaseous effluents; and (d) burning the gaseous effluents at a temperature from about 1000° C. to about 1500° C. under oxidizing conditions.

In a further embodiment of the present invention char can be separated from the solid effluents and treated to remove substantially all of the sulfur content which is present in the form of water soluble calcium sulfide.

The treated char is now in a form suitable for use as a low-sulfur-containing fuel.

DETAILED DESCRIPTION OF THE INVENTION

Coals suitable for use in the present invention must contain organic calcium in an amount such that the atomic ratio of organic calcium to sulfur is greater than 2 if the coal contains less than one weight percent sulfur and is greater than one if the coal contains more than one weight percent sulfur.

As is well known, coals are mixtures of organic carbonaceous materials and mineral matter. As is also well known, coals may contain metallic elements such as calcium in two manners: as mineral matter, e.g., separate particles of limestone and as the salts of humic acids dispersed throughout the organic phase. It is only the latter, organic calcium, which is useful for the present invention. Since organic calcium may be removed from coal by ion exchange, it is often referred to as ion exchangeable calcium.

It is rare for a coal with more than one weight percent sulfur to possess any organic calcium. It is also rare for a coal of less than one weight percent sulfur to possess an organic calcium to sulfur ratio greater than 2, but it is common for such coals to have a ratio of ion exchangeable sites to sulfur greater than 2. These coals are typically lignites and subbituminous. It has been taught in Catalysis Review 14(1), 131–152 (1976) that one may increase the calcium content of these coals by ion exchange, i.e., simple washing with an aqueous solution of calcium ions. Accordingly, it is within the scope of this invention to both use coals which are found in nature to possess adequate atomic ratios of organic calcium to sulfur as well as to use coals whose organic calcium to sulfur ratio has been increased by such techniques as ion exchange.

Many other coals, especially bituminous and anthracite coals, do not possess ion exchangeable sites or do not possess them in sufficient number. The ion exchangeable sites are typically carboxylic acid groups formed by mild oxidation. Accordingly, it is within the scope of the present invention to increase the number of ion exchangeable sites by mild oxidation with calcium being exchanged onto said sites either concurrently with their formation or in a subsequent process step. This mild oxidation may be performed by any means known in the art, including the techniques taught in U.S. patent application Ser. No. 6,700, filed Jan. 26, 1979 and incorporated herein by reference.

Coal is, in general, a very porous substance. Consequently, it is not critical to grind it into a finely divided state in order to carry out mild oxidation and/or ion exchange. Said processes may, however, be carried out with somewhat greater speed if the coal is more finely ground. Accordingly, it is preferred to grind the coal which is to be mildly oxidized and/or ion exchanged to the finest particle size that is consistent with later handling.

The combustion process of the present invention is a multi-stage process, i.e. it involves a first combustion stage under reducing conditions and a second combustion stage under oxidizing conditions. Any desired type of combustion chamber/burner, can be utilized in the practice of this invention so long as the chamber/burner is capable of operation in accordance with the critical limitations as herein described. Further, the combustion chamber employed in the second stage may be the same as or different from that employed in the first stage.

The first combustion stage of the present invention involves mixing the coal with a first oxidizing agent, preferably air, so that the equivalence ratio of coal to oxidizing agent is greater than about 1.5, and preferably greater than 2. This insures that the coal will burn in this stage under strongly reducing conditions. The term equivalence ratio (usually referred to as $\phi$) for purposes of this invention, is defined as:

$$\text{equivalence ratio } \phi = \frac{\dfrac{\text{actual fuel}}{\text{actual oxidizing agent}}}{\dfrac{\text{stoichiometric coal}}{\text{stoichiometric oxidizing agent}}}$$

Preferably, the equivalence ratio of coal to oxidizing agent for this first combustion stage is 1.5 to 4, preferably 2 to 3. As discussed previously, the temperature in this first combution stage is at least about 1200° C., preferable at least 1400° C., and more preferably 1400° C. to 1650° C.

It is well known that during fuel rich coal combustion, coal both oxidizes by reaction with $O_2$ and gasifies by reaction with $CO_2$ and $H_2O$. The former is strongly exothermic and rapid while the latter is somewhat endothermic and in general less rapid. Consequently if the reactor in which the first stage of combustion is carried out is not strongly backmixed, the temperature will be nonuniform, thereby achieving a peak value as the exothermic coal oxidation reaches completion and then declining as the endothermic gasification reaction proceeds. In this situation, the temperature of the first combustion zone which must be greater than 1200° C. and preferably greater than 1400° C., is the peak temperature.

It is to be noted that under some circumstances the endothermic nature of the gasification reaction may limit the extent to which gasification of the coal char approaches completion. This is not necessarily undesirable since as is discussed below, the ungasified char may be recovered and used as a fuel. In other situations, however, it may be desirable to supply additional heat to help drive the gasification reaction to completion. This may be done by increasing the extent to which the air entering the first stage of combustion is preheated prior to its admixture with the coal, or by so arranging the second combustion zone in relationship to the first in such a manner that radiation from said second combustion zone may heat said first combustion zone, or by other means known in the art.

After the coal is burned in the first combustion stage, the ash and char are removed and the resulting gaseous effluents are burned in a second combustion stage. This second combustion stage, contrary to the first, is performed under oxidizing conditions. That is, the ratio of gaseous combustible gases from the first stage of combustion to air added to the second stage of combustion is less than that ratio which corresponds to stoichiometric combustion. This requirement of oxidizing conditions in the second stage is necessary in order to assure complete combustion as well as to prevent the emission to the atmosphere of the pollutant carbon monoxide, which is well known in the art. The preferred range for the equivalence ratio in the second stage is 0.98 to 0.50, this being the range of normal combustion practices. The temperature in the second stage of combustion should have a peak value greater than about 1000° C. and less than about 1500° C. Temperatures below 1000° C. are not suitable because of problems, well known in the prior art, such as flame instability and loss of thermal efficiency which are encountered at such low temperatures. Similarly, it is well known in the art that under oxidizing conditions and at temperatures much above 1500° C., atmospheric nitrogen is thermally oxidized to NO. Since this NO would then be emitted as an air pollutant it is preferred to avoid its formation by operating the second stage of combustion at a peak temperature less than about 1500° C.

The residence time of solids in the first combustion stage is preferably at least 0.1 seconds, while the residence time of gases in both the first and second stage of combustion is preferably in the range 0.005 to 1 second.

The recovery of solids between the first and second combustion zones may be achieved by a variety of means known in the art. The recovered solids will consist of a mixture of ash and char. Since the char is unused fuel, the amount recovered, instead of being burned or combusted, directly reflects the inefficiency of fuel utilization. If the efficiency of fuel utilization is high and the recovered solids contain little char, then the solids may be disposed of by means known in the art. During this disposal process it may be desirable to oxidize the water soluble CaS in the ash to insoluble $CaSO_4$ in order to prevent the disposal of solids from creating a water pollution problem. If the efficiency of fuel utilization is not sufficiently high and the recovered solids contain significant amounts of char, then these solids may be used as fuel. It is well known in the art to operate fluid bed combustion systems in such a manner that $CaSO_4$ is thermodynamically stable and sulfur is thereby retained within the fluidized solids. Thus the recovered solids could be used as fuel for a fluid bed combustor in such a manner that their heating value would be realized and the sulfur they contain would not be discharged to the atmosphere. Instead this sulfur would leave the fluid bed combustor as $CaSO_4$ in the spent solids and be disposed of normally.

Alternatively the CaS may be removed from char/ash mixture by various means known in the art. One such means is simple leaching with an aqueous or dilute mineral acid solution, CaS being water soluble. The aqueous CaS solution would then be disposed of. Alternatively the char/ash mixture could be treated with steam and $CO_2$ so as to convert the CaS to $CaCO_3$ and gaseous $H_2S$, the gaseous $H_2S$ then being recovered and disposed of. However if CaS is removed from the char/ash mixture, there is some additional expense, but the resultant char is, in terms of its sulfur content, a premium fuel and may be used in those applications in which low sulfur fuels are critically required because other means of $SO_x$ emission control area nonfeasible.

The present invention, as described above, represents an unexpected discovery, the discovery that there exist a critical set of conditions under which coal containing organic calcium may be burned in two stages with minimal emissions of both $NO_x$ and $SO_x$. This suppression of the $SO_x$ emission is achieved by enhancing the extent to which sulfur is retained in the coal ash. The effectiveness of organic calcium in enhancing the retention of sulfur in ash is unexpected because when limestone is used as the calcium source, only a poor retention of sulfur in ash may be achieved. Furthermore, organic calcium is effective only under certain critical conditions as is shown by the following examples which serve to more fully described the manner of practicing the above-described invention, as well as to set forth the best modes contemplated for carrying out various aspects of the invention. It is understood that these examples in no way serve to limit the true scope of this invention, but rather, are presented for illustrative purposes.

EXAMPLES 1–5

Experiments were done in which a suspension of pulverized coal in air, at near atmospheric pressure, was flowed downward through an alumina tube in an electrical furnace. The temperature was measured with Pt/PtRH thermocouples and controlled electronically. After leaving the heated region of the alumina tube, the suspended solids were recovered from the gases via a filter. Air was added to the gases in such an amount that the mixture was an oxidizing mixture which was then passed through a tube in a second heated region, after which they were analyzed.

$SO_2$ in the oxidized gas was measured with a Thermoelectron Series 40 Pulsed Fluorescent $SO_2$ analyzer. $NO_x$ was measured with a Thermoelectron Chemiluminescent $NO_x$ analyzer. CO and $CO_2$ were measured with Beckman NDIR instruments.

At the completion of each run the solids on the filter were recovered and analyzed. The % combustible material of the recovered solids was determined and used to calculate the % fuel utilization, i.e. the % of the input fuel which because it burned was not recovered on the filter.

The recovered solids were also analyzed for sulfur using a Fischer Sulfur Analyzer, Model 470. From the known sulfur content of the coal feed and the sulfur content of the recovered solids, one can readily calculate the % sulfur retained by the solid, however one does not known how much of this sulfur is in organic sulfur in coal char and how much is inorganic CaS. CaS, however, is readily soluble in aqueous acetic acid while organic sulfur in char is not. Thus by extracting the recovered solids with aqueous acetic acid one may measure the percentage of the initial coals' sulfur content which is recovered in the solids as CaS.

The coal used in these experiments was Wyodak coal 0.55 wt. % sulfur, whose calcium content had been increased by washing with aqueous calcium acetate solution so that the organic calcium to sulfur ratio was 3.1.

Table 1 shows the results of a series of experiments at various temperatures. Below 1200° C. both the fuel utilization and the capture of the sulfur by the organic calcium to form CaS decrease markedly. This occurs despite the fact that the lower temperature runs were done at somewhat longer reaction times, a factor which should enhance both fuel utilization and CaS formation. This illustrates that at a temperature of at least 1200° C. is critically required for efficient sulfur capture.

EXAMPLES 6–10

Using the apparatus and procedures described in Example 1 and using Wyodak coal whose organic calcium content had been increased as per Example 1, another series of experiments was carried out with the results shown in Table II. Table III shows typical mass balances for these experiments.

In Table II it is shown that at temperatures about 1400° C. one can obtain not only acceptably high fuel utilization and efficient retention of sulfur in sulfur in the ash so that $SO_x$ emissions are minor but also very low $NO_x$ emissions, much lower than are achieved by conventional two stage combustion. Below 1400° C., however, the $NO_x$ emissions are of the same magnitude as is achieved in two stage combustion. This illustrates that temperatures of at least 1400° C. are preferred.

TABLE I

| Examples | Temperature in First Stage of Combustion, °C. | Reaction Time, Seconds | Equivalence Ratio | % Fuel Utilization | % of Input Coal Sulfur Present in Recovered Solids | % of Input Coal Sulfur Present in Recovered Solids in CaS |
|---|---|---|---|---|---|---|
| Comparative A | 1100 | 3.0 | 3.0 | 72 | 64 | 18 |
| 1 | 1200 | 2 | 3.2 | 88 | 82 | 51 |
| 2 | 1350 | 1 | 3.0 | 91 | 71 | 44 |
| 3 | 1450 | 1 | 3.1 | 95 | 64 | 52 |
| 4 | 1450 | 1 | 3.2 | 92 | 82 | 65 |
| 5 | 1550 | 1 | 3.2 | 96 | 85 | 74 |

TABLE II

Two stage combustion of a coal having an organic calcium to sulphur ratio of 3.5. Equivalence ratio in first stage about 3. Residence time in first stage about 1.5 seconds.

| Example | Temperature in First Stage of Combustion, °C. | % of Input Coal Sulfur Present in Recovered Solids | % of Input Coal Sulfur Present In Recovered Solids in CaS | % Fuel Utilization | $NO_x$ ppm |
|---|---|---|---|---|---|
| 6 | 1350 | 83 | 61 | 88 | 630 |
| 7 | 1350 | 71 | 44 | 91 | 547 |
| 8 | 1450 | 64 | 52 | 95 | 76 |
| 9 | 1450 | 82 | 65 | 92 | 124 |
| 10 | 1550 | 85 | 74 | 95 | 35 |

TABLE III

| | Typical Material Balances | | |
|---|---|---|---|
| T(°C.) | C | O | Ash |
| 1350 | 96.5 | 117 | 88.5 |
| 1450 | 98.5 | 125 | 93.5 |
| 1550 | 92.0 | 121 | 85.0 |

COMPARATIVE EXAMPLE B

A physical mixture of powdered coal and powdered limestone was prepared. The coal was Arkansas lignite, a coal in most respects similar to Wyodak, its wt. % S being 0.98 (based on the total weight of the coal) but having a calcium to sulfur ratio of only 0.29. The amount of limestone in the mixture was such that the ratio of total calcium to sulfur for the mixture was 3.5.

Using the apparatus and procedures described in Example 1, this physical mixture was burned in two stages, the first stage of combustion having an equivalence ratio of 3, a temperature of 1500° C., and a reaction time of 1.5 seconds.

The observed fuel utilization in this experiment was poor, only 58% in contrast to the much higher fuel utilizations shown for 1450° C. and 1550° C. in Table II. Further, the retention of sulfur in recovered solids was poor, only 56%, again in contrast to the higher values in Table II. Lastly, much of the retained sulfur was organic sulfur in the char and only 29% of the input coal's sulfur was present as CaS, again in contrast to the much higher values in Table II.

This illustrates that in order to obtain high retentions of sulfur in the coal ash while burning the coal efficiently, the use of organic calcium rather than physical mixtures of coal and solid inorganic calcium is critically required.

EXAMPLE 11

A sample of Arkansas lignite, 0.98 wt. % sulfur, was treated by the washing procedure of Example 1. After treatment, the calcium to sulfur ratio was 1.4. Using the apparatus and procedures described in Example 1, this coal was burned in two stages, the first stage of combustion having a reaction time of 1.5 seconds, an equivalence ratio of 3 and a temperature of 1500° C.

The observed fuel utilization was good, 92%, comparable with what is shown in Table II for a coal of higher Ca/S ratio. The sulfur retention in the recovered solids was, however, only 55% and the sulfur in the recovered solids as CaS was only 45%. These values are distinctly inferior to what is shown in Table II for experiments using a coal of higher organic calcium to sulfur ratio. This illustrates that for efficient sulfur retention an organic calcium to sulfur ratio greater than 2 is critically required for coals containing less than 1 wt.% sulfur.

EXAMPLE 12

The apparatus and procedures used in Example 1 were modified so that the second heated zone in which the gaseous effluents undergo the second stage of combustion was directly under the first heated zone wherein the first stage combustion occurs. Provisions were made so that the solids leaving the first stage of combustion could either be collected and recovered or permitted to pass through the second combustion zone and then be collected. Wyodak coal, 0.5 wt. % sulfur, treated as per Example 1 so that its Ca/S ratio was 2.9 was used. The equivalence ratio in the first and second stages of combustion were 3 and 0.7 respectively. The temperatures were 1400° C. and 1000° C. also respectively. Reaction times were 2 and 3 seconds respectively.

When solids were recovered prior to the second stage of combustion the fuel utilization was 93% and 63% of the coal's sulfur was in the recovered solids. When, however, the solids were allowed to pass through the second combustion zone fuel utilization rose to nearly 100% but only 23% of the coal's sulfur was in the recovered solids.

This illustrates that in order to achieve efficient retention of the sulfur in the ash and thereby prevent the emission of pollutants to the atmosphere it is critically necessary to recover the solids between the first and second stages of combustion.

EXAMPLE 13

Using the experimental procedures described in Example 1 a sample of Rawhide coal which had been treated to enhance its organic calcium content was combusted at varying equivalence ratios in the first stage of combustion. The results are shown in Table IV.

These results clearly demonstrate that use in the first stage of combustion of an equivalence ratio greater than 1.5 is necessary for useful sulfur retention and that use of an equivalence ratio greater than 2.0 is preferable.

EXAMPLE 14

A sample of Pittsburg No. 8 coal was ground, baked in air for 5 hours at 170° to 200° C. and thereby mildly oxidized. The coal was then treated with an aqueous solution containing calcium ions. Before treatment, the coal had 4 wt.% sulfur and no organic calcium whereas after treatment the coal had 2.4 wt.% sulfur and a calcium to sulfur ratio of 1.2.

This treated coal was then combusted at 1500° C. for about one second at a fuel to air equivalence ratio of 2.6. This resulted in a fuel utilization of 81%. The recovered char/ash mixture contained 84% of the coal's sulfur which in effect represented an overall control of $SO_x$ emissions of 90% because the pretreatment also removed some of the coal's sulfur.

This example demonstrates that for coals having a sulfur content of greater than one weight percent, an organic calcium to sulfur ratio greater than one but less than two is sufficient.

TABLE IV*

T = 1500° C., Rawhide Coal of 0.35 wt % sulfur, Ca/S = 10
Reaction Time = 1 second

| Equivalence Ratio | % of Input Coal Sulfur Present in Recovered Solids | % of Input Coal Sulfur Present in Recovered Solids as CaS | % Fuel Utilization |
|---|---|---|---|
| 1.0 | 7 | 7 | 100 |
| 1.5 | 28 | 16 | 98 |
| 1.9 | 41 | 29 | 95 |
| 2.0 | 46 | 26 | 92 |
| 2.2 | 55 | 40 | 93 |
| 2.3 | 62 | 46 | 91 |
| 2.4 | 53 | 39 | 94 |
| 2.6 | 73 | 52 | 88 |
| 2.8 | 65 | 45 | 86 |
| 2.9 | 79 | 57 | 88 |
| 3.1 | 77 | 59 | 89 |
| 3.7 | 86 | 60 | 78 |

*To minimize data scatter duplicate points have been averaged.

What is claimed is:

1. A coal combustion process wherein the emission of $SO_x$ is minimized which process comprises:

(a) providing a coal containing an organic calcium to sulfur ratio of at least 2 to 1 for coal containing less than 1 wt.% sulfur and at least 1 to 1 for coal containing greater than 1 wt.% sulfur;

(b) burning the coal at temperatures greater than about 1200° C. in a first combustion zone in the presence of an oxidizing agent but under reducing conditions such that the equivalence ratio of coal to oxidizing agent is at least 1.5;

(c) separating the resulting solid effluent from the gaseous effluent from the first combustion zone; and (d) burning the gaseous effluent at a temperature from about 1000° C. to about 1500° C. in a second combustion zone under oxidizing conditions.

2. The process of claim 1 wherein the equivalence ratio of coal to oxidizing agent in the first combustion zone is about 2 to 4.

3. The process of claim 1 wherein the solid effluent is treated to reduce its sulfur content.

4. A coal combustion process wherein the emission of $SO_x$ and $NO_x$ is minimized which process comprises:

(a) providing a coal containing an organic calcium to sulfur ratio of at least 2 to 1 for coal containing less than 1 wt.% sulfur and at least 1 to 1 for coal containing greater than 1 wt.% sulfur;

(b) burning the coal at temperatures greater than about 1400° C. in a first combustion zone in the presence of an oxidizing agent but under reducing conditions such that the equivalence ratio of coal to oxidizing agent is at least 1.5;

(c) separating the resulting solid effluent from the gaseous effluent resulting from the first combustion zone; and (d) burning the gaseous effluent at a temperature from about 1000° C. to about 1500° C. in a second combustion zone under oxidizing conditions.

5. The process of claim 4 wherein the equivalence ratio of coal to oxidizing agent in the first combustion zone is about 2 to 4.

6. The process of claim 4 wherein the solid effluent is treated to reduce its sulfur content.

* * * * *